US005881656A

United States Patent [19]

Grant

[11] Patent Number: 5,881,656

[45] Date of Patent: Mar. 16, 1999

[54] MATTRESS BORDER PRODUCTION METHOD AND APPARATUS

[76] Inventor: Andris P. Grant, 910 Brock Road South, Pickering, Ontario, Canada, L1W 1Z9

[21] Appl. No.: 821,922

[22] Filed: Mar. 21, 1997

[51] Int. Cl.[6] ..... D05B 11/00

[52] U.S. Cl. ..... 112/2.1; 112/470.33; 112/475.06; 112/475.08; 5/703

[58] Field of Search ..... 112/2.1, 470.27, 112/470.33, 470.34, 470.14, 141, 147, 152, 475.08, 475.07, 475.06; 5/703

[56] References Cited

U.S. PATENT DOCUMENTS

| | | | |
|---|---|---|---|
| 1,731,530 | 10/1929 | Goldeen et al. | 5/703 |
| 3,792,672 | 2/1974 | Friedman et al. | 112/152 X |
| 4,967,675 | 11/1990 | Goldbeck et al. | 112/147 X |
| 5,533,459 | 7/1996 | Fontana | 112/475.08 |

*Primary Examiner*—Peter Nerbun
*Attorney, Agent, or Firm*—Ridout & Maybee

[57] ABSTRACT

Mattress borders are manufactured by advancing and severing a strip of border maerial into first relatively short lengths of the border material for forming handles, and second relatively longer lengths of the border material for forming mattress borders, folding and hemming the relatively short lengths to form tubular handles, temporarily storing the formed handles out of the path of advance of the strip of border material, aligning formed handles so that their tubular axes extend laterally across the longer lengths of material at desired handle positions, and serging ends of the handles to edges of the longer lengths of material to form mattress borders with handles. The invention also extends to apparatus for performing this method. The disclosed method and apparatus enable mattress borders complete with handles to be formed from a single strip of material

17 Claims, 2 Drawing Sheets

MATTRESS BORDER PRODUCTION METHOD AND APPARATUS

This application claims the benefit of co-pending U. S. Provisional Application No. 60/013,789 filed Mar. 21, 1996.

FIELD OF THE INVENTION

The present invention relates to a method and apparatus for producing mattress borders.

BACKGROUND OF THE INVENTION

Automated machines been used for decades to measure and cut mattress borders to length. Cord handle grommets and backbars have been automatically installed in advance of a measuring drive on many machines. Other machines have finished border edges by using drive rollers to pull border material through sergers. Fabric handles; have been made manually from separate material stock and attached to borders.

OBJECTS AND SUMMARY OF THE INVENTION

An object of the present invention is to provide an automated means and method of attaching handles to a border, the handles being made from the same border material used to make the border itself.

According to the invention, a method of manufacturing mattress borders comprises advancing a strip of border material severing first relatively short lengths of the border material for forming handles, and second relatively longer lengths of the border material for forming mattress borders, folding and hemming the relatively short lengths to form tubular handles, temporarily storing the formed handles out of the path of advance of the strip of border material, aligning formed handles so that their tubular axes extend laterally across the longer lengths of material at desired handle positions, and serging ends of the handles to edges of the longer lengths of material to form mattress borders with handles.

The invention also extends to apparatus for forming mattress borders, comprising means for advancing a strip of mattress border material through metered lengths, means for severing the advanced and metered material into first relatively shorter and second relatively longer lengths, means for folding and hemming the first lengths of border material to form tubular handles and means to store the tubular handles out of a path of advance of the strip to form said second lengths, means to align tubular handles to extend transversely across the strip at predetermined intervals in the formation of said second lengths, means to advance the aligned handles with the strip, and sergers aligned with each edge of the strip and located downstream of said alignment means to secure ends of the aligned tubular handles to longitudinal edges of the strip.

Further features of the invention will be apparent from the following description of a presently preferred embodiment thereof.

SHORT DESCRIPTION OF THE DRAWINGS

DESCRIPTION OF THE PREFERRED EMBODIMENT

Figure 1:
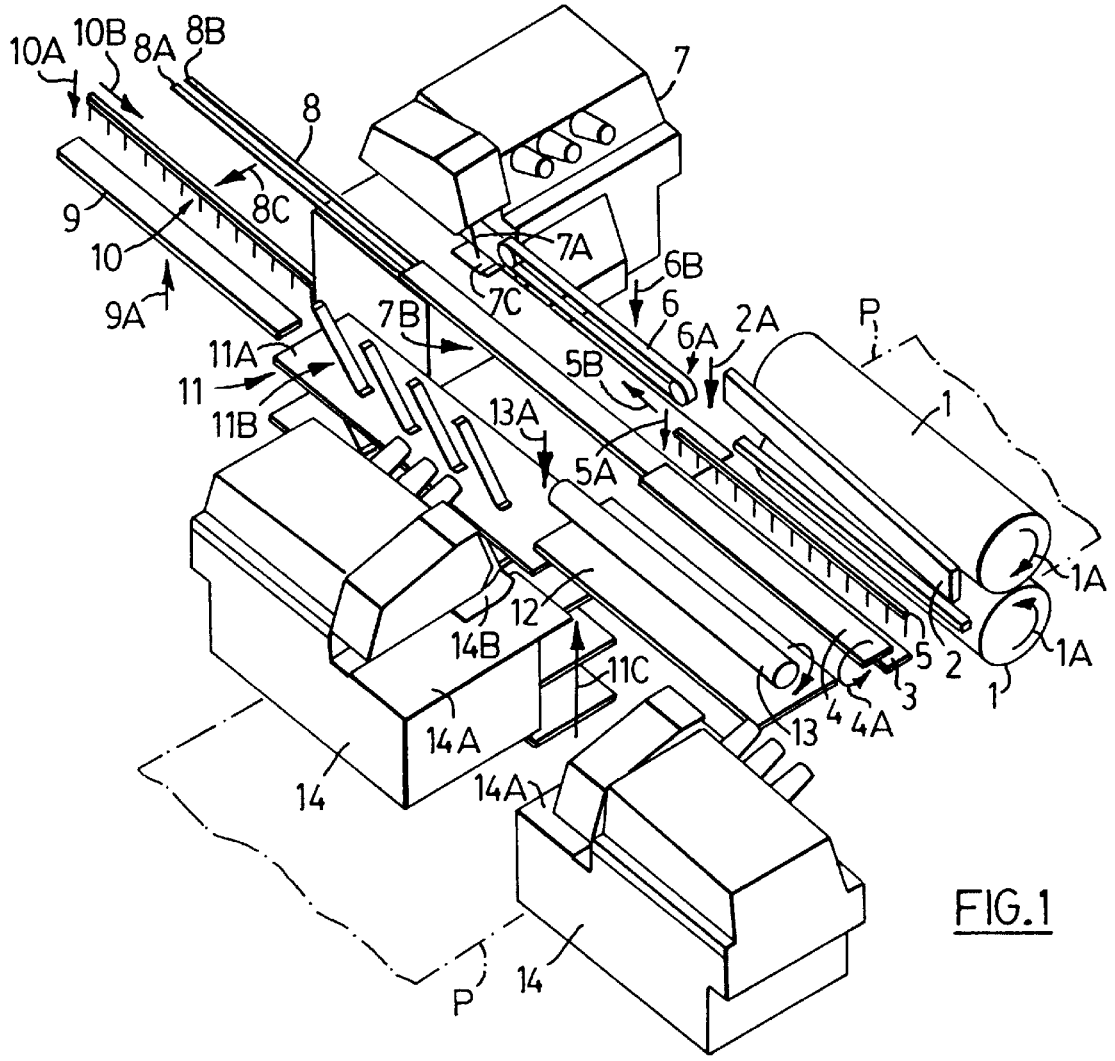
FIG. 1 shows a schematic embodiment of the mechanical elements of the present invention.

FIG. 1 shows schematically an embodiment of apparatus in accordance with the invention. In order to simplify the drawing and facilitate explanation, actuators and supporting structure associated with certain components are shown schematically by arrows indicating that an actuator or actuators is or are provided for supporting and moving the component along or about the axis indicated by the associated arrow or arrows, as identified further below.

A border material and cutting station Comprises a pair of drive rollers 1, nipping a strip B of border material level cross its width. A drive 1A feeds and meters border material through the roll nip, which is followed by a guillotine 2 for cutting off a length of border material, the guillotine having an actuator schematically illustrated by the arrow 2A.

A handle making station comprises a tongue 3, a paddle 4, a needle rake 5, a traction belt 6, a serger 7, chopsticks 8 and a tucker 9.

The tongue 3 is a thin flat length of metal in front of the guillotine 2, parallel to the drive rollers 1, and just below the border material path, extending to beside the needle 7A of the serger. The width of the tongue is less than the width of a handle.

The paddle 4 is a thin flat piece of metal parallel to the tongue 3, extending across and above the border material path. The paddle is rotationally mounted and has an actuator 4A to pivot it about an axis parallel to the tongue 3 to a position where the top (previously the bottom) of the paddle is at a level below the tongue and part of the paddle is visible on the guillotine 2 side of the tongue when looking from above.

A first needle rake 5 supports a row of pins across and above the border material path, the pins pointing down towards that part of paddle 4 which, when rotated, is visible from above. A first actuator 5A supports and moves the rake in a vertical direction so that it may be lowered to a position where the pins just clear the top of the rotated paddle. An actuator 5B supports and moves the rake in a horizontal direction parallel to the tongue 3 so that it may be moved to a position clear of the border material path when viewed from above.

The traction belt 6 is a belt about the length of rake 5, supported on pulleys at each end of which pulley 6A is a driving pulley, and extends outside of the path of the strip and parallel to the rake 5 on a line between the rake and the guillotine 2, at a level above the path of the border material. The traction belt has an actuator 6B to move it in a vertical direction and may be lowered to a position where the bottom of the traction belt just clears the level of the top of the paddle 4 when the latter is rotated, such that it draws material off the paddle.

The serger 7 is a commercial sewing machine for sewing together an/or finishing fabric edges. The serger is located so that the material path through the serger is parallel to the traction belt 6, and at a level such that a cloth plate 7B of the serger is the same level as the top of the paddle when rotated. The serger cloth plate is extended forward of the serger to the end of the paddle, when rotated, and passes under the traction belt. The serger presser foot 7C faces the end of the traction belt, the serger needle 7A being located approximately in the center of the presser foot.

The chopsticks 8 are a pair of steel rods of diameter similar to the thickness of the tongue 3, with a length equal to the width of the border material. Their normal position is in line with the tongue as shown. Each chopstick is individually movably mounted by an actuator mechanism 8C for movement in a horizontal direction parallel to the axis of motion of the border material. The lead chopstick 8A furthest from the serger needle 7A may be moved away from the serger to a store position, over a distance twice that between the guillotine 2 and the furthest edge of the tongue in the direction of border material flow. The chopstick 8B closer to the serger needle may be moved so that at a store position there is a space between the chopsticks less than the distance between the guillotine and the furthest edge of the tongue in the direction of border material flow.

The tucker 9 is a rectangular rubber block, parallel to the chopsticks 8, of chopstick length and of a width less than half the chopstick separation at the store location. It is located slightly above the chopsticks at the store location with its edge furthest from he serger 7 over the lead chopstick 8A at its store location. The tucker is mounted for movement in a vertical direction by an actuator 9A and may be raised to a level high enough to disengage from material supported by the chopsticks.

A storage and retrieval station comprises a needle rake 10, elevator 11 and platform 12. The needle rake 10 has a row of pins, pointing down and connected to each other at their top ends by a backbar of length equal to the width of border material. Rake 10 is located just clear of and parallel to the tucker 9 on its side facing serger 7, at a level where the bottom of the pins is clearly above the level of the border material. Rake 10 is movably mounted by actuator 10A for movement in a vertical direction and may be lowered to a position where the pins engage material supported on the chopsticks 8$\mu$. At Rake 10 is also movably mounted by an actuator 10B for movement in a horizontal direction, parallel to the tongue 3, and may be moved to a location between the chopsticks 8 when at the store location, to a location adjacent the elevator 11, or a location adjacent the platform 12.

The elevator 11 has a series of identical shelves 11A with springs 11B, stacked on top of another facing the chopsticks 8 at their store position. The shelf length is equal to the horizontal separation between the ends of the chopsticks adjacent the store and the nearer edge of the border material path P through the apparatus. The shelf width is about the distance between the guillotine 2 and the furthest edge of the tongue 3 in the direction of border material flow. The shelf separation is greater than the total vertical travel of rake 2. Several leaf springs 11B are located just above each shelf. The leaf springs may be compressed upwards by the double thickness of the border material and are angled to permit material movement off the chopsticks and towards the border material path. The leaf springs viewed from above, are parallel to and just clear of the rake 10 on side of the tucker 9. The stack of shelves and springs forming the elevator mounted, for movement as a unit in the vertical direction, by an actuator 11C. The top of each shelf may be brought by the actuator to a level just below that of the chopsticks, or level with the platform 12.

The platform 12 is a plate of the same width as a shelf 11A, with a length equal to the border material width. It is located just above the border material path adjacent the elevator 11.

A handle attachment station comprises a feed roll 13, and left and right sergers 14. The feed roll 13 is a rubberized roller of about the same diameter as the width of the tucker 9. Viewed from above, it extends parallel to and just clear of rake 10 on the tucker side. It is located above the platform 12 at a level such that the bottom of the roller is at least at a height of the needles of the rake 10 when in a raised position. The roll 10 is supported for vertical movement by an actuator 13A which lowers it towards the platform.

The left and right sergers 14 are located opposite each other on either side of the border material path so as to serge the edges of the border material, at a level such that the serger cloth plates 14A are just beneath the edges of the border material. The serger needles 14B are located a horizontal distance from the nearer edge of the platform 12 that is less than the distance between the guillotine 2 and the furthest edge of the tongue 3 in the direction of border material flow.

In operation of the apparatus, handles H (See FIGS. 2A and 2B) are made first from a length of border material B and attached to a mattress border formed from the same material. The handles are formed and attached as follows.

The rollers 1 feed a first relatively short metered length of border material through the guillotine 2 and over the tongue 3. The paddle 4 folds the material around the tongue. The pins of rake 5 are pressed through both material layers by actuator 5A. The actuator 2A causes the guillotine to cut off the piece. Actuator 5B causes rake 5 to move the folded piece laterally under the traction belt 6 which is lowered by actuator 6B to hold the piece. Rake 5 is lifted and withdrawn and returned for the next piece by actuators 5A and 5B.

The traction belt 6 is advanced to feed the folded piece into a serger 7. The serger sews the adjacent edges of the piece together to make a tubular handle which it feeds onto the pair of chopsticks 8. Actuator 8C causes the chopsticks to move the tubular handle forward, parallel to the path of movement of the strip of border material. The leading chopstick 8A passes below the tucker 9 that engages the material of the tubular handle forcing it to roll around the chopsticks to bring the hem underneath.

The pins of rake 10 are inserted in the handle by the actuator 10A and the tucker 9 raised by actuator 9A. The actuator 10B causes the rake 10 to move the handle into the elevator 11 onto a shelf 11A where it is held by springs 11B. The rake 10 is withdrawn. The elevator shelves are indexed by actuator 11C after rake 10 returns or the next handle.

As many handles are made as are required for a finished mattress border, before the border itself is formed. If the capacity of the elevator is sufficient, handles for several borders may be made before forming several borders to which to attach them.

Borders are made as follows. When the handle piece for the last of a series of handles is at the traction belt 6, the rollers 1 feed a second, relatively greater length of border material through the guillotine 2 and over the tongue 3 to the left and right sergers 14. The sergers draw the border material through and sew its edges.

Handles stored in the elevator 11 are retrieved for attachment to the mattress border as follows. A shelf 11A with a handle is moved to the level of the platform 12 above the border material path. The pins of rake 10 are reinserted in the handle by actuator 10A and actuator 10B causes the rake to move the handle to the platform. Roll 13 is lowered by actuator 13A to hold the handle, and the rake pins are withdrawn. The elevator 11 is indexed and the rake 10 returns for the next handle.

Figure 2A:
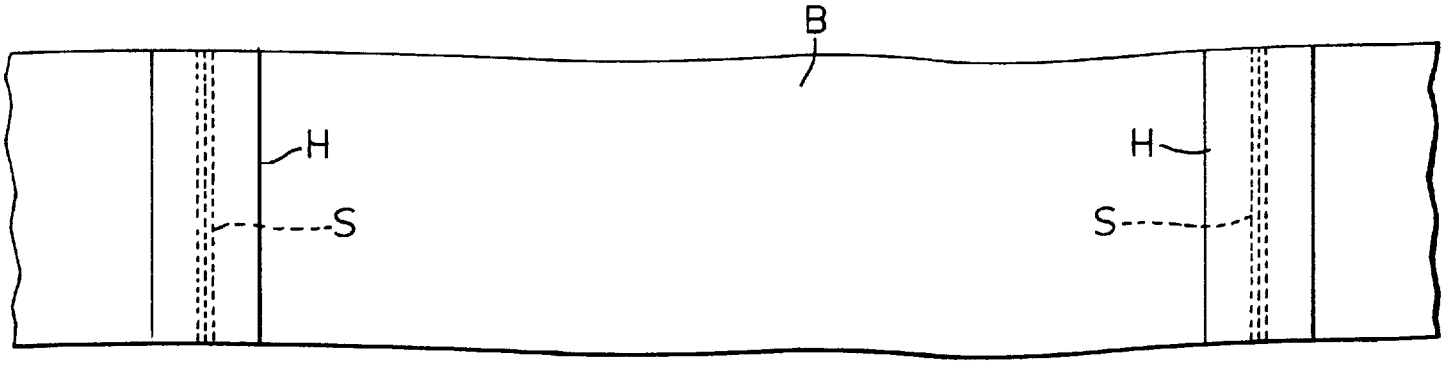
FIG. 2A and 2B are plan and edge views of a portion of a mattress border made by the method of the invention.
Figure 2B:
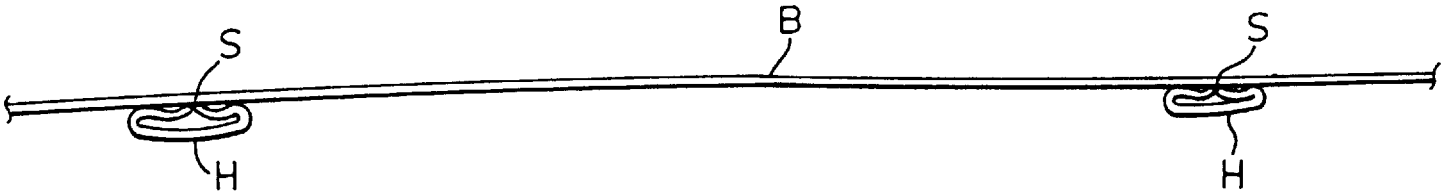

The roll 13 feeds the first handle off the platform 12 onto the moving border and into the sergers, and is then raised. The left and right sergers 14 sew the ends of the tubular handle H to the border with the hems S hidden beneath the handles. Subsequent handles are sewn in the border at intervals to provide a border as shown in FIGS. 2A and 2B. The feed rollers and sergers are stopped when a sufficient length of material has been fed to form the border and the guillotine 2 cuts the border to length. Serging is restarted and the trailing end of the border finished.

The mattress border apparatus may be used to make mattress borders of various lengths and widths with differing numbers of handles. The apparatus may also be used to make borders without handles or to make handles alone. Provision may be made to give extra support and guidance to very flexible border material. In order to strengthen the handle, a reinforcing core of cord or webbing may be folded into the tubular handles H.

Although a preferred technique for handle attachment has been described, variations are possible. Thus handles may be rotated for attachment to line up with the direction of border material flow, and attached to the border by a sewing machine, gluing, welding, clipping or other means. Finished border material may be used for the input border material strip.

While presently preferred instrumentalities have been described for performing each of the functions comprised by the method and apparatus of the invention, each of these instrumentalities may be substituted by alternative instrumentalities capable of performing an equivalent function, and all such substitutions are to be considered within the scope of the appended claims.

I claim:

1. A method of manufacturing mattress borders, comprising the steps of severing border material in the form of a strip into first relatively shorter lengths of the border material for forming handles, and second relatively longer lengths of the border material for forming mattress borders, temporarily storing the relatively shorter lengths out of of the path of advance of the strip of border material, aligning the relatively shorter lengths on the longer lengths of material at desired handle positions, and attaching ends of handles, formed by the relatively shorter lengths, to the longer lengths of material to form mattress borders with handles.

2. A method according to claim 1, including the step of folding and hemming the relatively short length to form tubes such that the longitudinal axes of the tubes will extend transversely to longer lengths when aligned therewith in handle positions; and wherein the attachment of the tubes to the longer lengths is by serging them to the longitudinal edges of the latter.

3. Apparatus for forming mattress borders, comprising means for advancing mattress border material in the form of a strip through metered lengths, means for severing the advanced and metered material into first relatively shorter and second relatively longer lengths, means to store the shorter lengths out of a path for advance of the strip to form said longer lengths, means to align the shorter lengths from said storage means on the strip at predetermined intervals in the formation of said longer lengths, means to advance aligned handles, formed by the shorter lengths, with the strip, and means located downstream of said alignment means to secure ends of the aligned handles to the strip.

4. A method according to claim 2, including the step of rotating the tubes about their tubular axes such that when aligned, the hems formed by the hemming step face the strip during advance to form the longer lengths.

5. A method according to claim 1, wherein the first lengths of material are displaced laterally out of the path of advance of the strip for and storage.

6. A method according to claim 5, wherein the first lengths of material are folded in two prior to being displaced laterally.

7. Apparatus according to claim 4, wherein the folding means comprises a paddle and a tongue extending across and on opposite sides of a path of advance of the strip, the paddle being rotatable about the tongue to fold a first length cut from the strip around the tongue to bring ends of such a length adjacent.

8. Apparatus according to claim 7, wherein the hemming means comprises a serger spaced laterally from the path of advance of the strip, and means to move adjacent ends of a folded first length through the serger.

9. Apparatus according to claim 8, wherein the means to move the adjacent ends through the serge t comprises a rake bar, means to actuate the rake bar vertically to engage and disengage from the folded length, means to actuate the rake bar transversely to the path of advance of the strip to move a first length engaged by the rake bar along the tongue towards the serger, and a feed belt to feed the adjacent ends through the serger to produce a hem at said adjacent ends, thus forming the folded first length into a tube handle surrounding the tongue.

10. Apparatus according to claim 8, wherein the means to store the tubes comprises longitudinally extending guide means for receiving a tube from the tongue, a second rake, means to move the guide means in a direction parallel to the path of advance of the strip to a position beneath the second rake, actuator means to engage the rake with the tube and move the second rake laterally to draw the tube off the guide means, and a storage means to receive tubes withdrawn from the guide means.

11. Apparatus according to claim 10, further including a tucker located to engage the tube as the guide means is moved parallel to the strip and rotate the tube on the guide means by approximately one-quarter turn.

12. Apparatus according to claim 10, wherein the guide means comprises a pair of independently moveable parallel chopsticks.

13. Apparatus according to claim 10, wherein the storage means comprises a stack of vertically movable shelves, and means to move individual shelves vertically in and out of positions in which tubes can inserted onto and removed from a shelf.

14. Apparatus according to claim 10, wherein the means to align tubes include a platform beneath the path of the strip downstream of the tongue, a feed roller above the platform and the path, an actuator to move the feed roller towards the table to press a tube against the strip, to cause the feed roller to move it conjointly with the strip into the sergers aligned with each edge of the strip.

15. Apparatus according to claim 13, wherein the actuator means for the second rake is operable to move the rake in an extended lateral path between the storage means and the platform whereby to move a tubular handle from the storage means to the table.

16. Apparatus according to claim 3, including means to fold and hem the relatively short links to form tubes, and wherein the means to align the shorter lengths aligns them so that the longitudinal axes of the tubes are transverse to the strip, and wherein the attachment means are sergers aligned with each edge of the strip.

17. Apparatus according to claim 6, wherein the means for advancing the strip is a pair of drive and metering rolls forming a roll nip, and the severing means is a guillotine coordinated with said metering rolls to sever first and second lengths.

* * * * *